US007818156B2

(12) United States Patent
Vachhani et al.

(10) Patent No.: US 7,818,156 B2
(45) Date of Patent: Oct. 19, 2010

(54) CORROSION ASSESSMENT METHOD AND SYSTEM

(75) Inventors: Pramod Vachhani, Bangalore (IN); Sunil Shirish Shah, Bangalore (IN); Collin Wade Cross, Houston, TX (US); Yatin Tayalia, Bangalore (IN); Nishith Pramod Vora, Bensalem, PA (US); Raghunandan Murthy, Bangalore (IN)

(73) Assignee: General Electric Company, Niskayuna, NY (US)

( * ) Notice: Subject to any disclaimer, the term of this patent is extended or adjusted under 35 U.S.C. 154(b) by 386 days.

(21) Appl. No.: 11/934,815

(22) Filed: Nov. 5, 2007

(65) Prior Publication Data

US 2008/0257782 A1 Oct. 23, 2008

Related U.S. Application Data

(63) Continuation-in-part of application No. 11/736,819, filed on Apr. 18, 2007, now abandoned.

(51) Int. Cl.
*C10G 7/10* (2006.01)

(52) U.S. Cl. ..... 703/12; 703/9; 702/182; 208/47

(58) Field of Classification Search ..... 208/47; 702/182; 703/9, 12
See application file for complete search history.

(56) References Cited

U.S. PATENT DOCUMENTS

| | | | |
|---|---|---|---|
| 4,647,366 | A | 3/1987 | Edmondson |
| 4,855,035 | A | 8/1989 | Schutt |
| 5,182,013 | A | 1/1993 | Petersen et al. |
| 5,464,525 | A | 11/1995 | Edmondson |
| 5,500,107 | A | 3/1996 | Edmondson |

FOREIGN PATENT DOCUMENTS

| | | | |
|---|---|---|---|
| JP | 2302495 | A | 12/1990 |
| JP | 07-082572 | A | 3/1995 |
| JP | 2004-252781 | A | 9/2004 |

*Primary Examiner*—Robert J Hill, Jr.
*Assistant Examiner*—Brian McCaig
(74) *Attorney, Agent, or Firm*—Mary L. Gioeni

(57) ABSTRACT

A method includes assessing corrosion in a refinery operation having a piping network. Assessing can include identifying in a petroleum sample a presence and an amount of a species determined to be potentially corrosive to corrodible equipment in a refinery. A corrosion risk presented by the presence, the amount, and the boiling point of the species is determined. And, the corrosion risk is evaluated in view of piping network information. A system for implementing the method is provided, also.

16 Claims, 2 Drawing Sheets

CORROSION ASSESSMENT METHOD AND SYSTEM

CROSS-REFERENCE TO RELATED APPLICATIONS

This patent application is a continuation-in-part of U.S. patent application Ser. No. 11/736,819, filed on Apr. 18, 2007, now abandoned, the contents of which are hereby incorporated by reference.

BACKGROUND

1. Technical Field

Embodiments of this invention relate to a method for corrosion assessment. Embodiments of this invention relate to a system for implementing a method of corrosion assessment.

2. Discussion of Art

Petroleum may be obtained as crude oil, and may contain a complex mix of components. One type of component is a naphthenic acid or naphthenic acid precursor. The presence of naphthenic acid or naphthenic acid precursor can affect the corrosion potential of the crude oil.

Crude oil is "sweet" if it contains less than 0.5% sulfur, compared to a higher level of sulfur in sour crude oil. Sweet crude oil may contain a small amount of hydrogen sulfide and carbon dioxide. High quality, low sulfur crude oil may be processing into gasoline and is in high demand. "Light sweet crude oil" is a most sought-after version of crude oil as it contains a disproportionately large amount of these fractions that are used to process gasoline, kerosene, and high-quality diesel. Sour crude oil contains impurities such as hydrogen sulfide, carbon dioxide, or mercaptans. While all crude oil contains some impurities, if the total sulfide level in the oil is >0.5% the crude oil is called "sour". The term "opportunity crude oil" refers to crude oil that is of non-standard origin or is from a field that is of unknown or varying quality or composition. The presence of sulfur and sulfur compositions can affect the corrosion potential of the crude oil.

Corrosion may be problematic in petroleum refining operations of crude oils. Corrosion in atmospheric and vacuum distillation units at temperatures greater than about 200 degrees Celsius may be of concern. Some corrosion may be associated with corrosive species, such as those disclosed above. Factors that contribute to the corrosivity or corrosion potential of crude oil that contains corrosive species include the amount of naphthenic acid present, the molecular structure of the naphthenic acid precursor, the concentration of sulfur compositions, the total availability of the acids, the velocity and turbulence of the flow stream in the units, and the like.

High temperature corrosion control attempts have included blending a higher naphthenic acid content crude oil with a relatively low naphthenic acid content crude oil; neutralizing or removing naphthenic acid precursors from the crude oils; and use of corrosion inhibitors. Corrosion inhibition of the inward-facing metallic surfaces of refinery equipment has been attempted by adding an additive to the crude oil. The additives known so far include a phosphate composition containing at least one aryl group, and a mercaptotriazine composition.

Refineries monitor the corrosion by placing corrosion monitoring devices in locations throughout the refineries. Unfortunately, identifying suitable monitoring locations is a challenge as the identified spots should be representative of the corrosion level of the entire system. That is, the corrosion monitoring devices only see a small patch of area within a large piping network, and cannot extrapolate that data to represent non-monitored areas. Without information on the general corrosion state, or the specific corrosion state in non-monitored areas, choosing an appropriate treatment response may be problematic. The treatment response may include variables such as dosage type, amount, frequency, and location for addition. Without informational guidance, the treatment response may not be as effective as is possible or desirable.

A further complicating factor is a lack of an adequate corrosion model for naphthenic acid precursors and sulfur compositions corrosion factors. Without an adequate model, the various naphthenic acid precursors and sulfur compositions are treated equally—despite their actual behavior showing they do not contribute equally to corrosion. The necessary but inadequate presumption that all naphthenic acid components and sulfur compositions have the same corrosive tendency has led to discrepancies in treatments and actions taken at crude oil refineries.

There may be a need for a method of assessing corrosion that differs from those methods currently available. There may be a need for a system capable of assessing corrosion that differs from those systems that are currently available.

BRIEF DESCRIPTION

In one embodiment, a method is provided that includes assessing corrosion in a refinery operation having a piping network. Assessing can include identifying in a petroleum sample a presence and an amount of a species determined to be potentially corrosive to corrodible equipment in a refinery. A corrosion risk presented by the presence, the amount, and the boiling point of the species is determined. And, the corrosion risk is evaluated in view of piping network information.

In one embodiment, a method is provided that includes assessing a corrosion potential of a corrosive species in a piping network in a refinery. The assessment includes determining optimal amounts of additives to a crude oil containing the corrosive species to reduce or eliminate the corrosive potential.

In one embodiment, a system is provided that includes a readable medium coupled to a processor capable of assessing corrosion in a refinery operation having a piping network. The readable medium includes data that identifies in a petroleum sample a presence and an amount of a species in a crude oil sample determined to be potentially corrosive to corrodible equipment in a refinery. The processor determines a corrosion risk presented by the presence, the amount, and the boiling point of the species; and evaluates the corrosion risk to a piping network in view of piping network information.

DETAILED DESCRIPTION

Embodiments of this invention relate to a method for corrosion assessment. Embodiments of this invention relate to a system for implementing a method of corrosion assessment.

As used herein, the terms "may" and "may be" indicate a possibility of an occurrence within a set of circumstances; a possession of a specified property, characteristic or function;

and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable.

Approximating language, as used herein throughout the specification and clauses, may be applied to modify any quantitative representation that could permissibly vary without resulting in a change in the basic function to which it is related. Accordingly, a value modified by a term or terms, such as "about" is not limited to the precise value specified. In some instances, the approximating language may correspond to the precision of an instrument for measuring the value. Similarly, "free" may be used in combination with a term, and may include an insubstantial number, or trace amounts, while still being considered free of the modified term. The singular forms "a", "an" and "the" include plural referents unless the context clearly dictates otherwise.

A method and system is taught for using a model to determine the corrosion tendency of specified corrosive species used in a refinery, using the determined tendency to optimize and control the corrosion, and finally determining the optimal placement of corrosion monitoring devices in the facility for optimal facility operation. Embodiments of the method comprise the prediction of high temperature corrosion for different streams in atmospheric and the vacuum columns based on crude oil characteristics, operating conditions and the presence of any inhibitors or other treatments. Additionally, in an embodiment of the invention, an optimization framework for selecting crude oil blends and/or treatment dosage to keep corrosion rates below a specified threshold is provided. Another embodiment provides for a method to assist refinery operators in identifying corrosion hot spots through shear by using fluid dynamics techniques, and allows for extrapolation of corrosion rates for same stream using shear profile.

Figure 2:
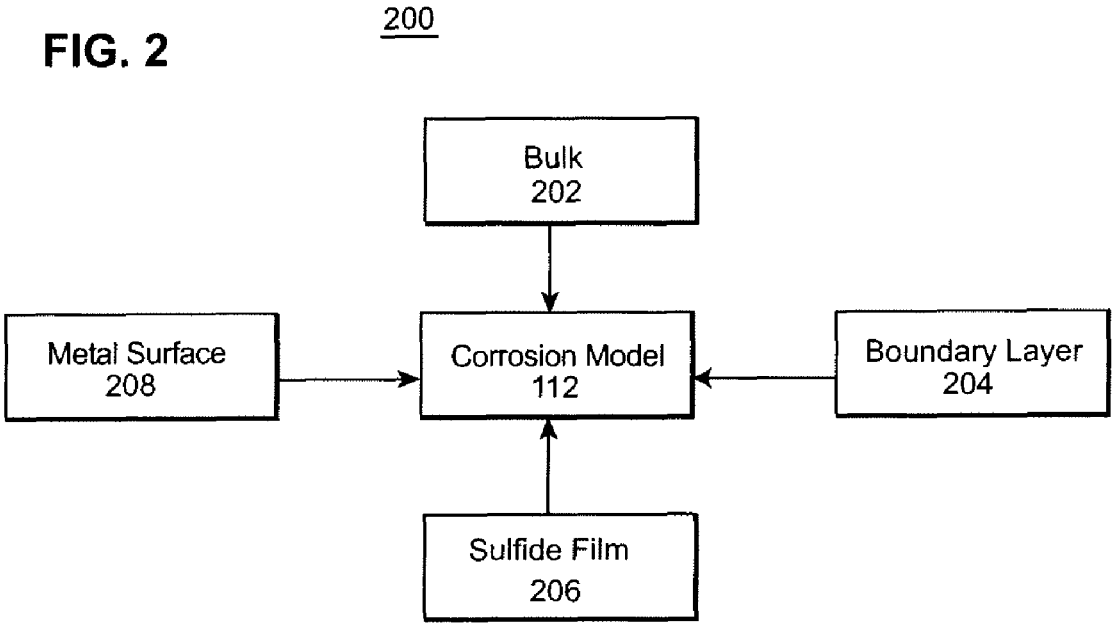
FIG. 2 is a block diagram of an illustrative embodiment of the corrosion model.

Two families of species that may increase the corrosion potential of crude oil may include naphthenic acids and sulfur compositions. The naphthenic acids and naphthenic acid precursors may include, for example, the structures shown in FIG. 2. The corrosion is driven by chemical kinetics and may be expressed through an Arrhenius equation or a competitive reaction expression.

The sulfur-containing species may include one or more of hydrogen sulfide, mercaptan, elemental sulfur, sulfide, disulfide, polysulfide, and thiophenol. A difference between corrosion caused by sulfur-containing species and by naphthenic acids may be seen through the corrosion byproduct. A corrosion byproduct for naphthenic acids is iron naphthenate. A corrosion byproduct for sulfur-containing species is iron sulfide. Iron naphthenate is more soluble in crude oil than iron sulfide. As a result, the iron sulfide tends to form a sulfide film, which may prevent or reduce further corrosion in some instances, or may form a local corrosion cell that pits in other instances. Pitting may affect system integrity faster than general corrosion.

With the sulfur species, "active sulfur" is the sum total of available corrosive sulfur present in the crude oil. Similar to the naphthenic acid, the true boiling point distribution of active sulfur is used to characterize the pseudo-components of active sulfur.

Figure 1:
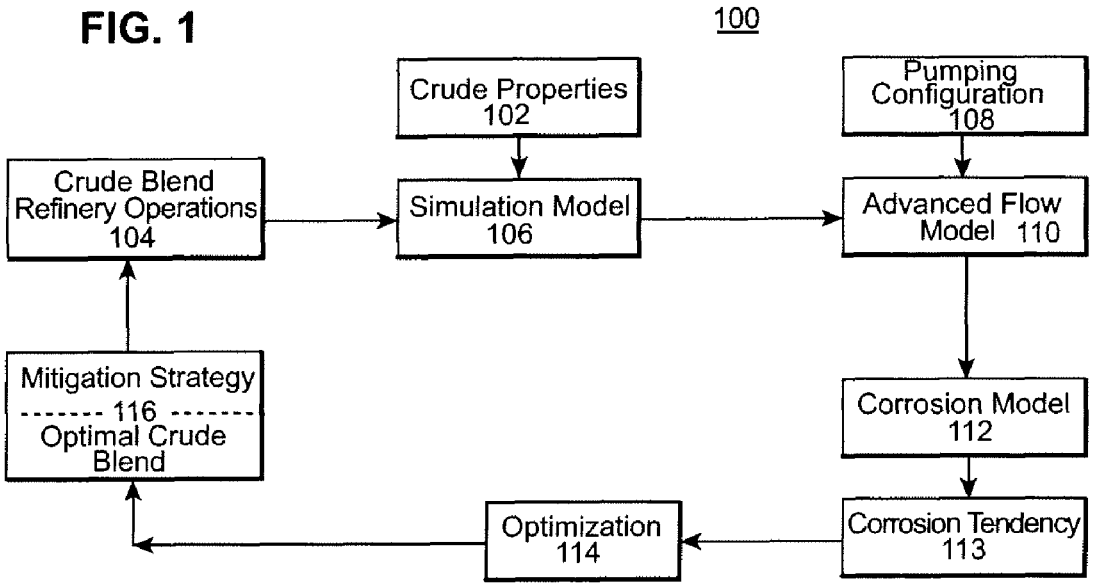
FIG. 1 is a block diagram of an illustrative embodiment of a system high temperature corrosion predictive framework.

With reference to FIG. 1, a prediction framework 100 determines corrosion risk or corrosion tendencies of a particular crude oil or crude oil blend (with reference to particular piping components). The framework comprises a number of actions, including characterizing the corrosive species and capturing the corrosion process, and mitigating corrosive damages by optimizing crude oil blends or providing counteractive additives.

The crude oil properties 102 and refinery operation conditions 104 are used to form a corrosion model 106. The crude oil properties can include the presence of corrosive species, the amount of the corrosive species, and the true boiling point of the corrosive species. The refinery operation conditions include the type and operating conditions of a piece of equipment in the refinery. Such equipment may include a crude oil distillation column. The corrosion model can simulate the operation of the refinery equipment, under the determined operating conditions, and in contact with the corrosive species. The corrosion model can predict or determine properties of the various draw-off streams from the distillation column.

In different draw-off streams of the distillation columns, corrosive species can have a differing concentration and differing corrosive tendencies. These corrosive tendencies may be characterized using a pseudo-component approach. The pseudo-component approach provides that crude oil samples from different sources distilled at a particular temperature range have similar vapor liquid equilibrium properties. Once in possession of the true boiling point of the corrosive species, a corresponding pseudo-component construct can be formed. Given a distillation model, the concentration of corrosive species pseudo-components can be tracked across the column draw off streams.

Piping network information includes data on the piping network at a system level and at a piping component level. For example, piping network information can include the material(s) from which the piping components are formed, the length of the pipe runs, the piping diameter, the piping thickness, the type and location of piping joints, the turns and angles of the piping, the temperatures to which the piping is subject by area, surface treatments of the pipe, age of the components, and like information. Piping network information 108, including configurations and properties, is gathered to form information on the relevant piping network configurations. The presence and amount of the corrosive species impact the mass transfer and film dynamics in the piping network. The piping network information and the corrosion model determination are processed into a flow model 110. The flow model may predict the average shear in the piping network. The flow model may predict the localized shear in the piping network. For example, different sulfur compositions will result in varying film build up and removal, directly impacting the shear within the network.

In one embodiment, the advanced flow model is a computational fluid dynamics model. The information from the corrosion model and the advanced flow model 110 is fed into the corrosion model 112 to predict the corrosion rate. The corrosion model basis its prediction on the particular corrosive species, such as for example naphthenic acid and sulfur compositions. It has been found that the more information provided, the more accurate the model. Some information considered useful in this process, but in no means intending to be limiting, includes the naphthenic acid concentration, the cut temperature, the operating temperature, and mass spectrometry data, including molecular structure. This corrosion rate may be used for a second tier or step of an embodiment of the process, which is the optimization 114.

FIG. 3 illustrates an embodiment of a corrosion model with its various components 200. There are four main corrosion model components: reactions occurring in bulk 202, reactions occurring at a boundary layer 204, reactions occurring at or underneath a sulfide film 206 and the reactions occurring at a metal surface 206. The bulk reactions require inputs from distillation or corrosion models, including the percent of the corrosive materials, for example, the percent of naphthenic acid, the percent of sulfur compositions, the naphthenic acid regeneration, the naphthenic acid decomposition, and the decomposition of the sulfur compositions.

The boundary layer reaction is based on with the mass transport across the boundary layer, or hydrodynamic film, which is relative to the advanced flow model, or the computational fluid dynamics model. This first resistance depends on oil conditions, including density, viscosity, shear, and velocity.

The sulfide film reaction is based on the mass transport through sulfide film and the inherent dynamics of sulfide film. This resistance depends on the thickness of the sulfide film, and is also relative to the wall shear that acts upon it, which is a function of the rate at which the sulfur compositions reach the wall, the rate at which the sulfur compositions corrode to form sulfide and the rate at which the sulfide is removed due to wall shear. As the thickness of the surface increases, a film or layers of film are formed, and with high shear from the high velocity the film gets torn off, and so affects the fluid dynamics, and the corrosion rate. This is also related to the advanced flow or computational fluid dynamics models.

The last step comprises the reaction at the metal surface of the piping or vessel. The chemical kinetics is based on at least in part on the function of species concentration, species type, reaction temperature, and metallurgy.

An optimization step 114 is based on the refinery requirements or desired results. In one embodiment, the variables and information can be used to optimize the mitigation strategy 116, in order to mitigate the corrosion and keep it below an accepted or threshold level. An alternate embodiment is to optimize the crude oil blends 116 used, so as to control the amount of naphthenic acid and sulfur compositions in the crude oil. A third embodiment is to combine the two, and optimize both the crude oil blends 118 and the mitigation strategy.

The optimization step includes a control aspect of high temperature corrosion in refineries. This process requires a physics based model of corrosion phenomenon that takes into account at least the crude oil properties and potential treatments. Two metrics that impact the final output or decision are the cost of treatment of the crude oil, and the extent of permissible or acceptable corrosion threshold. Treatment may include the addition of a corrosion inhibitor. The optimization process for choosing crude oils, taking into account the crude oils available and the permitted range of combinations, comprises examining the overall economics of the crude oils and crude oil blends, including the potential returns based on different products, as well as the potential cost of treatment of the crude oils, such as dosing with inhibitors. An alternate embodiment provides for a means to identify the type and extent of dosage of treatment, such as inhibitors, to keep the corrosion rates under prescribed or threshold limits. Alternately, the cost of corrosion rate, which is determined by the cost of replacement of the piping including materials, labor, or downtime can be determined and can be compared to the cost of the chemicals or inhibitors to restrict the corrosion rate, and thereby increase the overall life of the piping. This comparison will show whether dosing the crude oils with inhibitors would be more economically expedient than replacing a defined portion of the piping or a piping component. A further alternative is to combine the two, and have a combination of inhibitor dosing with a defined lifespan of the piping.

The metrics described above can be used as an objective function to solve a mixed integer non-linear programming (MINLP) problem. For instance, if treatment with an inhibitor is the chosen metric to optimize, or is the available degree of freedom, the integer part arises due to various options available for treatment and by varying the effect of said options. If the choice of crude oil blend is the available the MINLP will optimize the cost of the blends versus the economic returns on the products. If both metrics are available degrees of freedom, i.e., the combination is chosen, the MINLP problem can be extended to optimized the cost of treatment required to maintain a prescribed corrosion rate in combination with the cost of crude oil blend compared to the economic return on products. The MINLP problem can be solved through use of popular and well-known MINLP techniques or global optimization techniques, such as genetic algorithms.

Another embodiment of the invention includes a third tier, which may assist refinery operators in identifying corrosion hot spots through shear by using fluid dynamics techniques. This method also extrapolates corrosion rates for same stream using shear profiles. Identifying critical locations to place corrosion monitoring devices is a challenge, mostly due to limited flow or geometry aspects that are not taken into account.

For the third tier, or an additional step in an embodiment, the fluid flow in the piping network on a component-by-component basis is studied for various operating conditions in view of differing crude oil properties and geometric parameters. Correlations are used so that local maximum stress locations can be located that depend upon the factors and parameters. The magnitude of the maximum stress locations can also be determined due to fluid flow and droplet impingement in piping components.

This information can be integrated with additional information, including but not limited to, concentration and nature of the corrosive species, temperature of the crude oils and the piping, and metallurgy of the system, and from that corrosion rates at specified locations can be determined. Therefore, the places in the refinery most susceptible to corrosion, or the corrosion hot spots, can be located. Once these hot spots have been identified, the refineries can be monitored with appropriate corrosion measuring devices.

Simultaneously, corrosion rates at other places within the refinery can be semi-quantitatively predicted by extrapolating the data collected from the monitoring devices. This extrapolation is conducted by using the same piping and varying the fluid dynamics properties along the piping. At the same time, by mapping hydrodynamics, or more particularly, the stress conditions as seen by the measuring device can be tuned to the mainstream, and better measurement of the corrosion rate due to actual stream can be determined.

Also, an array of sensors may be provided in the piping network to supply information about conditions in the piping network. This sensor information may be used as an additional basis to determine corrosion risk.

The foregoing embodiments are illustrative of some of the features of the invention. The appended claims are intended to claim the invention as broadly as it may have been conceived and the examples herein presented are illustrative of selected embodiments from a manifold of all possible embodiments. Accordingly, the appended claims are not to be limited by the choice of examples utilized to illustrate features of the present invention. Where necessary, ranges have been supplied, those ranges are inclusive of all sub-ranges there between. It is to be expected that variations in these ranges will suggest themselves to a practitioner having ordinary skill in the art and where not already dedicated to the public, those variations should where possible be construed to be covered by the appended claims. It is also anticipated that advances in science and technology will make equivalents and substitutions possible that are not now contemplated by reason of the imprecision of language and these variations should also be construed where possible to be covered by the appended claims.

The invention claimed is:

1. A method, comprising:

assessing corrosion in a refinery operation having a piping network, comprising:

identifying in a petroleum sample a presence and an amount of a species determined to be potentially corrosive to corrodible equipment in a refinery; and determining a corrosion risk presented by the presence, the amount, and the boiling point of the species; and evaluating the corrosion risk in view of piping network information.

2. The method as defined in claim 1, wherein piping network is a portion of a distillation column.

3. The method as defined in claim 2, wherein the corrosion risk is further based on properties of draw off streams of the distillation column.

4. The method as defined in claim 1, wherein the species comprise naphthenic acid or derivatives thereof.

5. The method as defined in claim 1, wherein the species comprise one or more sulfur compositions.

6. The method as defined in claim 5, wherein the sulfur compositions comprise one or more of hydrogen sulfide, mercaptan, elemental sulfur, sulfide, disulfide, polysulfide, or thiophenol.

7. The method as defined in claim 1, wherein assessing corrosion further comprises:

determining pseudo-components of naphthenic acid and active sulfur;

introducing the pseudo-components to an advanced flow model;

introducing the piping network information to the advanced flow model; and introducing information from the advanced flow model into a corrosion model.

8. The method as defined in claim 1, further comprising optimizing a blend of two or more crude oil samples to reduce, mitigate or eliminate the corrosion risk.

9. The method as defined in claim 8, wherein optimizing is performed using a mixed integer non-linear program.

10. The method as defined in claim 1, further comprising identifying locations in the piping network that are relatively more susceptible to corrosion based on the corrosion risk and piping network information.

11. The method as defined in claim 10, wherein identifying locations comprises extrapolation of a corrosive range using the piping network information and varying the fluid dynamics properties of a model relative to location in the piping network.

12. The method as defined in claim 1, wherein the corrosion risk is based on one or more of reactions occurring in bulk, reactions occurring at a boundary layer, reactions occurring at or underneath a sulfide film, and the reactions occurring at an exposed metal surface.

13. The method as defined in claim 1, wherein corrosive species in different draw-off streams of distillation columns have a differing concentration and differing corrosive tendencies characterizable using a pseudo-component approach.

14. The method as defined in claim 13, further comprising determining a true boiling point of the identified corrosive species to form a corresponding pseudo-component construct.

15. The method as defined in claim 14, wherein a distillation model of the corrosive species is provided, and further comprising tracking the concentration of corrosive species pseudo-components across the column draw off streams.

16. The method as defined in claim 1, further comprising sensing conditions in the piping network, and determining the corrosion risk is further based on the sensed conditions.

* * * * *